United States Patent [19]

Komon et al.

[11] Patent Number: 4,578,290

[45] Date of Patent: Mar. 25, 1986

[54] METHOD OF AND APPARATUS FOR COATING

[75] Inventors: Koichi Komon, Suzuka; Siro Ito, Kawasaki; Shuichi Seino, Hirakata, all of Japan

[73] Assignee: Honda Giken Kogyo Kabushiki Kaisha, Tokyo, Japan

[21] Appl. No.: 673,178

[22] Filed: Nov. 19, 1984

[30] Foreign Application Priority Data

Mar. 2, 1984 [JP] Japan ..... 59-39986

[51] Int. Cl.[4] ..... B05D 1/02

[52] U.S. Cl. ..... 427/421; 427/284; 427/286; 427/424; 118/300; 118/301; 118/314; 118/315

[58] Field of Search ..... 427/424, 421, 286, 284, 427/285; 118/300, 301, 314, 315

[56] References Cited

U.S. PATENT DOCUMENTS

| | | | |
|---|---|---|---|
| 1,807,858 | 6/1931 | Morris | 427/424 |
| 3,885,066 | 5/1975 | Schwenninger | 118/314 X |
| 3,890,921 | 6/1975 | Szczepanski | 118/301 X |

*Primary Examiner*—Shrive P. Beck

*Attorney, Agent, or Firm*—Burgess, Ryan & Wayne

[57] ABSTRACT

From knowledge of the fact that the pattern of the film of coating produced on a surface by spray coating varies with the distance between the nozzle of the spray gun and surface, the nozzle 2 of a spray gun 1 that is disposed facing an outermost end of a surface to be coated is axially inclined so that the external ridge-line of the fan-shaped spray produced thereby is almost perpendicularly with or slightly inwardly inclined to the plane of the surface, the distance as measured along the ridge-line between the nozzle and the surface being selected so that the spray gun can produce in the surface W a film of coating sharply defined at the contour, without unwanted spots of paint called the "tails" at both ends of the film.

8 Claims, 8 Drawing Figures

METHOD OF AND APPARATUS FOR COATING

BACKGROUND OF THE INVENTION

The present invention relates to a method of and apparatus for producing a sprayed film of coating sharply defined in contour.

When spray coating is used to produce a pattern or area of a color over or adjacent to another surface pre-coated in different color, as when coating automobile bodies, that edge of the pre-coated surface is also exposed to paint particles currently sprayed so that the outline of the newly coated area occurs other than sharply defined. To obviate this, in conventional spray coating jobs, the adjacent precoated surface which should not be sprayed is covered with masking tape along a sufficiently wide area bordering to its bounding line or entirely to prevent it from being smeared with the sprayed paint particles. After coating, these masking tapes are removed. However, those conventional methods are rather inefficient and not suitable for conveyor production line coating. In addition, those parts of the paint which are deposited on the masking tape entail an utter waste. Moreover, the removal of masking tape results in different problems depending on the time when it is removed. For example, when the coated film is dried, removal causes it to crack, leaving a jagged line along the bounding line. When the film is half-dried, those undried parts of paint which might not entirely adhere to the currently sprayed area can also be peeled off with the tape being removed, with the boundary having a resultant jagged outline.

SUMMARY OF THE INVENTION

The present invention has for its object to provide an efficient method of and apparatus for producing sprayed films of coating in sharply defined contour, without the use of masking.

In this invention, the fact that the films of spray coating occur differently depending on the distance between the sprayer nozzle and surface to be coated, is noted. In more detail, the spray gun is held tightly tilted at such an angle that the outermost parts of discharged paint in the fan-shape it forms in spraying are directed almost perpendicularly or little more inclinedly with respect to the surface to be coated and, at the same time, within a maximum distance from the surface just outside of which spraying mightly possibly produce unwanted spots of paint across the border to the adjacent area to be not coated.

BRIEF EXPLANATION OF THE DRAWINGS

FIG. 6 presents schematic views showing the shape of sprayed paint particles discharged from an airless type spray gun, wherein FIG. 6*a* is an axial cross-sectional view of the spray, FIG. 6*b* shows the spray in transverse cross-section seen at different points from the sprayer nozzle, and FIG. 6*c* presents side views of the coated film produced at the foregoing different points.

DESCRIPTION OF THE PREFERRED EMBODIMENTS

Figure 1:
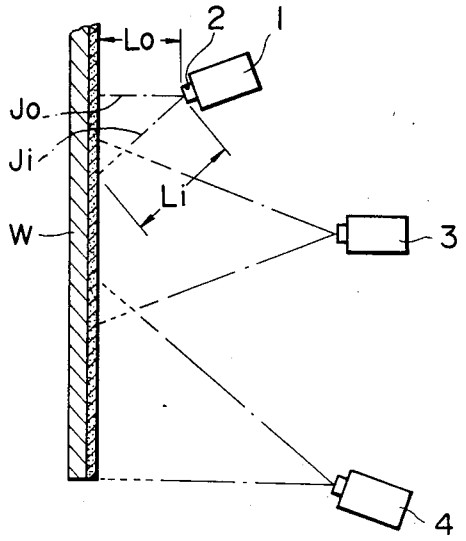
FIG. 1 is a schematic side view of the arrangement of the apparatus according to a preferred embodiment of the present invention in which the spray guns face the surface to be coated, as seen from side.
Figure 3:
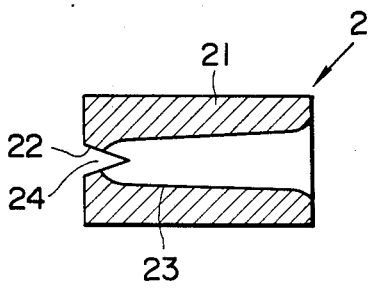
FIG. 3 is a cross-sectional view of an orifice-type fan-discharge nozzle in accordance with a preferred embodiment of this invention.

In FIG. 1, which is a view showing an example of a preferred embodiment in accordance with the present invention, the numeral 1 designates a first airless-type spray gun which is installed in the arrangement to spray on an outermost part of a surface to be spray coated. The spray 1 may have an orifice-type fan-discharge nozzle 2 having a nozzle body 21 made of hard material such as hard metal and comprising a dome-shaped inside wall surface 23, a lip-shaped orifice 24 and a V-shaped notch 22 formed in the forward end of the nozzle 2, as shown in FIG. 3.

Figure 6:
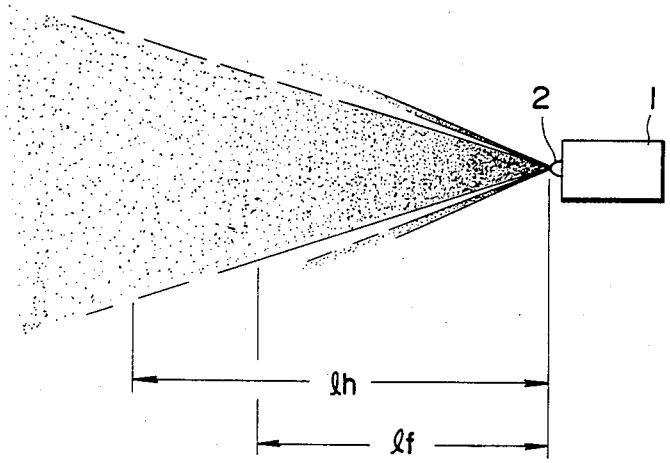
Figure 6:
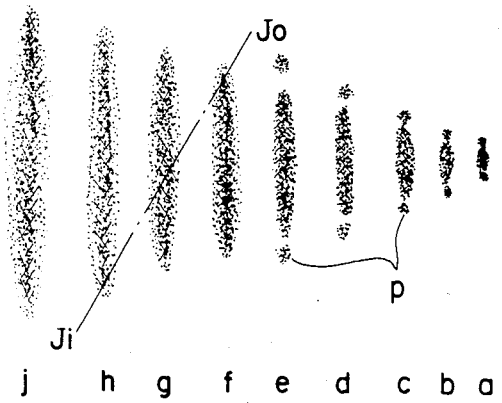
Figure 6:
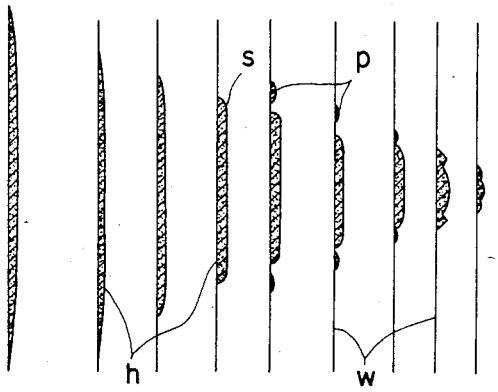

It has been found that the spray of paint discharged from an airless-type spray gun 1 equipped with the aforesaid orifice-type, fan-discharge nozzle 2 entails formation, apart from the central elliptical sprayed pattern, of unwanted spots p of paint known in technical terminology as the "tails" at opposite ends of the elliptical pattern, as depicted in FIG. 6*b*, when the spray gun sprays at too close range from the surface W to be coated. These tails p are found to become less conspicuous as the distance between the surface W and the nozzle 2 is greater and less marked with decreasing distance between them. They do not occur at all when this distance exceeds a certain range (farther than f). On the other hand, the film of coating sprayed becomes more sharply defined at the end thereof, indicated at s in FIG. 6*c*, as the distance between the surface and the nozzle is smaller and is gradually reducing in thickness toward the ends.

The present invention utilizes these characteristics of spray coating. According to this invention, the axis of the nozzle 2 is inclined with respect to the surface to be coated such that, on the one hand, the distance as measured along the external ridge-line of the fan-shaped spray discharged from the nozzle is minimized to such a range as to prevent formation of tails p and as to insure sharpness at the end s of the film and, on the other hand, the distance as measured along the internal ridge-line of the spray is set to such a range as to cause the film t to gradually reduce in thickness toward the other end thereof. The spray gun thus can produce a film t of coating sharply defined at the end s thereof without the use of masking.

In other words, the first spray gun 1, which is installed for spraying on an outermost end of a surface to be coated, is supported inwardly inclinedly with respect to the surface W, as shown in FIG. 1, such that the external ridge-line Jo of the fan-shaped spray discharged from the nozzle 2 is almost perpendicular with or more inwardly inclined to the plane of the surface W. At the same time, the distance Lo as measured along the external ridge-line Jo between the nozzle 2 and the surface W is minimized to such a range as to prevent occurrence of tails p or splashing and as to insure increased sharpness at the end s of the film produced. This distance Lo corresponds to the distance lf indicated in FIG. 6(*a*) and may be 1 cm at the smallest or, more preferably in the range from 5 to 10 cm, depending on the viscosity of the paint, discharged pressure and discharged amount, very much smaller than in conventional spray coating. On the other hand, the distance Li as measured along the internal ridge-line Ji of the fan-shaped spray is set to such a range as to permit double-coating by an adjacent spray gun 3. This distance Li corresponds to the distance lh shown in FIG. 6(*a*), and may be comparable to distances used in conventional spray coating to produce films t gradually decreasing in thickness toward its periphery.

The second spray gun 3 is equipped with the same type of fan-discharge lip-type nozzle as the first spray gun 1 and mounted next to the first spray gun 1, spaced from the surface W such a distance as is normally taken in the prior art coating methods.

A third spray gun 4 is also equipped with the same type of nozzle as the first and second spray guns 1 and 3. This third spray gun is spaced from the surface W to be coated a slightly smaller distance than in conventional spray coating and held inclined inwardly (upwardly in FIG. 1) at substantially the same angle as the first spray gun 1 is tilted.

Figure 2:
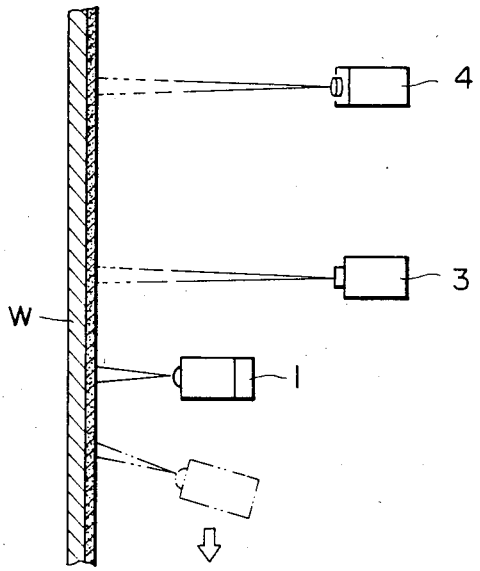
FIG. 2 is a top view of the arrangement of FIG. 1 in which the spray guns are depicted to show its direction of movement relative to the surface.

These spray guns 1, 3 and 4 are installed on separate mountings (not shown) to face the surface W to be coated, arranged in spaced apart relationship to prevent interference therebetween during the operation, and staggered with respect to one another in the longitudinal direction of the surface W, as best shown in FIG. 2. Also, the spray guns are movably disposed for relative movement with respect to the surface W.

Figure 5:
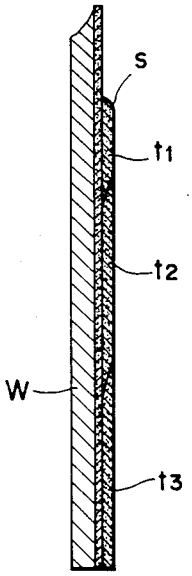
FIG. 5 is a cross-sectional view of an example of a film of spray coating produced by the apparatus according to this invention.

The operation of the apparatus with the aforesaid arrangement to produce a film of coating will be described with reference to FIGS. 1 and 5.

The spray guns 1, 3 and 4 discharge paint from their respective nozzle while moving in the longitudinal direction of the surface W. The spray of paint discharged in fan shape from the nozzle 2 of the first spray gun 1, which is supported to spray on an outermost end of a surface to be coated, forms in the surface W a first film t1 of coating having its external end, shown at s in FIG. 5, sharply outlined where the paint is sprayed at close range and with great angles. On the other hand, this first coated film has its internal end opposite to the external end s gradually decreasing in thickness where the paint is sprayed from farther distances and with smaller angles.

As opposed to this, the fan-shaped spray of paint discharged from the nozzle of the spray gun 3 forms in the surface W a second film t2 of coating that is gradually reducing in thickness toward its both ends and relatively larger in dimension since this second spray gun is supported to face straight the surface at such a normal distance as in conventional spray coating. The second film overlaps at that end near the first spray gun with the first film tl to merge into a composite continuous layer.

In addition, the spray of paint discharged in fan shape by the third spray gun 4, which is disposed adjacent to the second spray gun 3 and inwardly inclined, produces a third film t3 of coating whose part is overlapped with the film t2 so that a larger continuous layer of coating of uniform thickness is produced to comprise the first, second and third films.

Figure 4:
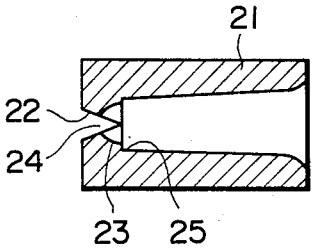
FIG. 4 is a cross-sectional view of an orifice-type fan-discharge nozzle in accordance with another embodiment of this invention.

The nozzle 2 for the first spray gun 1 may be of the type disclosed in Japanese Published patent application No. 47-4799 which, as shown in FIG. 4, includes an annular stepped portion 25 formed at the boundary between the cylindrical portion of the cavity 23 and the dome-shaped portion and a V-shaped notch 22 cut deep to or beyond the point of that boundary, so shaped to prevent formation of the unwanted tails p. In addition, to make the film more smooth in the surface, the first spray gun may be supported in a horizontally rotated position, as shown in broken line in FIG. 2. In this particular embodiment, the spray guns used are identical. However, they may be different in discharged amount and spray angle depending on the desired shape of the work. Their discharge pressure may be adjusted for desired purposes from the range between 50 to 120 $Kg/cm^2$.

A flat surface was sprayed with metal paint at a pressure of 70 $Kg/cm^2$ by the aforesaid first, second and third spray guns that are supported in the inclined positions at 18°, 0° and 20°, spaced 5 cm, 15 cm and 15 cm from the surface and at discharge angles of 40°, 50° and 35°, respectively, the first spray gun being of the type indicated in FIG. 3. The film portion produced by the first spray gun was sharply defined at its periphery. Moreover, the film portions overlapped by different spray guns were excellent and uniform in thickness. The same process was repeated with different kinds of paints with the requirements of operation altered to meet the particular paint type and the results obtained were found satisfactory.

What is claimed is:

1. A method of producing a film of spray coating sharply defined in contour, comprising supporting the nozzle of an airless-type spray gun that is disposed for spraying on an outermost end of a surface to be coated in an axially inclined position such that the external ridge-line of the fan-shaped spray discharged from said nozzle is almost perpendicular with or slightly inwardly inclined to the plane of said surface, the distance as measured along said external ridge-line between said nozzle of said spray gun and said surface being minimized to such a range as to prevent formation of stains of paint and gradual reduction of film thickness at one end of a film and as to insure sharpness of the outline at said end of said film.

2. A method of producing a film of spray coating sharply defined in contour, comprising the steps of:

supporting the nozzle of a first airless-type spray gun that is disposed for spraying on an outermost end of a surface to be coated in an axially inclined position such that the external ridge-line of the fan-shaped spray discharged from said nozzle is almost perpendicular with or slightly inwardly inclined to the plane of said surface, the distance as measured along said external ridge-line between said nozzle of said spray gun and said surface being minimized to such a range as to prevent formation of stains of paint and gradual reduction of film thickness at one end of a film and as to insure sharpness of the outline at said end of said film; and supporting a second spray gun adjacent to said first spray gun on the internal side and at a greater distance from said surface than said first spray gun, said second spray gun being mounted in such a manner that the axis of the nozzle thereof is directed at substantially right angles with respect to the plane of aid surface, wherein said first spray gun produces in conjunction with said second spray gun a merged wide layer of coating sharply defined at its one end.

3. A method as set forth in claim 2, comprising moving said spray guns relative to and in the longitudinal direction of said surface while causing them to spray paint so as to provide a merged film of coating in said surface.

4. A method as set forth in claim 2, comprising use of a plurality of spray guns differing from one another in discharged amount and spray angle, wherein they are operated in conjunction to produced a single merged layer of coating in said surface.

5. An apparatus for spray coating comprising an airless type spray gun having a fan-discharge nozzle which is installed for spraying on an outermost end of a surface to be coated, said spray gun being supported in an inclined position such that the external ridge-line of the fan-shaped spray discharged from said nozzle of said spray gun is almost perpendicular with or slightly more inwardly inclined to the plane of said surface, the distance as measured along said external ridge-line being minimized to such a range as to prevent formation of stains of paint and gradual reduction of film thickness at an end of a film.

6. An apparatus as set forth in claim 5, wherein said fan-discharge nozzle of each of said airless-type spray guns has a lip-shaped orifice including a V-shaped notch formed at the tip of the main body thereof, said V-shaped notch being communicated with a dome-shaped cavity formed in the inside of said main body.

7. An apparatus as set forth in claim 5, wherein said fan-discharge nozzle of each of said airless-type spray guns includes an annular stepped portion at the boundary between said dome-shaped cavity and a cylindrical portion formed in the inside of said main body, said V-shaped notch being extended at least so far as the point of said boundary to provide a communicating portion at the mouth of the orifice.

8. An apparatus for spray coating comprising:

a first airless type spray gun having a fan-discharge nozzle which is installed for spraying on an outermost end of a surface to be coated, said spray gun being supported in an inclined position such that the external ridge-line of the fan-shaped spray discharged from said nozzle of said spray gun is almost perpendicular with or slightly more inwardly inclined to the plane of said surface, the distance as measured along said external ridge-line being minimized to such a range as to prevent formation of stains of paint and gradual reduction of film thickness at an end of a film; and a second airless-type spray gun having a fan-discharge nozzle which is mounted adjacent to said first spray gun on the internal side and spaced a greater distance from said surface than said first spray gun, said second spray gun being supported in such a manner that said nozzle of said second spray gun is directed at substantially right angles with respect to the plane of said surface, said second spray gun being spaced from said first spray gun to prevent interference therebetween during the operation.

* * * * *